US012702157B2

(12) United States Patent
Jordil

(10) Patent No.: US 12,702,157 B2
(45) **Date of Patent: *Aug. 11, 2026**

(54) SMOKING ARTICLE INCLUDING A FLAVOUR DELIVERY MEMBER

(71) Applicant: PHILIP MORRIS PRODUCTS S.A., Neuchatel (CH)

(72) Inventor: Yves Jordil, Lugrin (FR)

(73) Assignee: Philip Morris Products S.A., Neuchatel (CH)

( * ) Notice: Subject to any disclaimer, the term of this patent is extended or adjusted under 35 U.S.C. 154(b) by 556 days.

This patent is subject to a terminal disclaimer.

(21) Appl. No.: 17/460,029

(22) Filed: Aug. 27, 2021

(65) Prior Publication Data

US 2022/0046983 A1 Feb. 17, 2022

Related U.S. Application Data

(63) Continuation of application No. 16/568,992, filed on Sep. 12, 2019, now Pat. No. 11,109,618, which is a (Continued)

(30) Foreign Application Priority Data

Mar. 28, 2013 (EP) ..... 13161785

(51) Int. Cl.
*A24D 3/06* (2006.01)
*A24D 3/10* (2006.01)

(52) U.S. Cl.
CPC ..... *A24D 3/061* (2013.01); *A24D 3/062* (2013.01); *A24D 3/10* (2013.01)

(58) Field of Classification Search
None
See application file for complete search history.

(56) References Cited

U.S. PATENT DOCUMENTS 2,755,206 A 7/1956 Statia, Sr.
4,811,745 A 3/1989 Cohen
(Continued)

FOREIGN PATENT DOCUMENTS

CA 2031727 10/2001
CN 101115408 1/2008
(Continued)

OTHER PUBLICATIONS

Brown & Williamson Tobacco Corporation, "Capri Technology", Nov. 1986, 27 pages.
(Continued)

*Primary Examiner* — Katherine A Will
(74) *Attorney, Agent, or Firm* — Mueting Raasch Group

(57) ABSTRACT

There is provided a filter for a smoking article. The filter comprises a filter segment comprising filter material, and the filter segment has a cross sectional area measured perpendicular to the longitudinal direction of the filter. The filter further comprises a flavour delivery member embedded in the filter segment and surrounded on all sides by the filter material. The flavour delivery member comprises structural material enclosing liquid flavourant for flavouring smoke during smoking of a smoking article provided with the filter, and the flavour delivery member releases at least a portion of the liquid flavourant when the filter is subjected to external force. The cross sectional area of the flavour delivery member measured perpendicular to the longitudinal direction of the filter is about 30% of the cross sectional area of the filter segment or greater.

17 Claims, 1 Drawing Sheet

Related U.S. Application Data continuation of application No. 14/778,734, filed as application No. PCT/EP2014/056350 on Mar. 28, 2014, now Pat. No. 10,433,578.

(56) References Cited

U.S. PATENT DOCUMENTS

| | | | | |
|---|---|---|---|---|
| 4,893,638 | A | 1/1990 | Lauterbach | |
| 4,925,602 | A | 5/1990 | Hill | |
| 5,186,185 | A | 2/1993 | Mashiko | |
| 5,225,277 | A | 7/1993 | Takegawa | |
| 5,271,419 | A | 12/1993 | Arzonico | |
| 6,041,790 | A * | 3/2000 | Smith | A24F 42/20 131/360 |
| 6,422,244 | B1 | 7/2002 | Clarke | |
| 6,502,582 | B1 | 1/2003 | Peters | |
| 7,243,659 | B1 | 7/2007 | LeCoultre | |
| 7,578,298 | B2 | 8/2009 | Karles | |
| 7,787,962 | B2 | 8/2010 | Chitre et al. | |
| 7,787,963 | B2 | 8/2010 | Geistert et al. | |
| 7,856,991 | B2 | 12/2010 | Badertscher | |
| 7,878,962 | B2 | 2/2011 | Karles | |
| 8,459,272 | B2 | 6/2013 | Karles | |
| 8,613,284 | B2 | 12/2013 | Hutchens | |
| 8,820,331 | B2 | 9/2014 | Hartmann | |
| 8,939,155 | B2 | 1/2015 | Zitturi | |
| 9,210,952 | B2 | 12/2015 | Stokes | |
| 9,339,060 | B2 | 5/2016 | Hartmann | |
| 9,486,010 | B2 | 11/2016 | Barnes | |
| 2004/0074507 | A1 | 4/2004 | MacAdam | |
| 2004/0250827 | A1 | 12/2004 | Deevi | |
| 2004/0261807 | A1 | 12/2004 | Dube | |
| 2005/0000529 | A1 | 1/2005 | Bereman | |
| 2005/0066980 | A1 | 3/2005 | Crooks | |
| 2005/0066982 | A1 | 3/2005 | Clark | |
| 2006/0174901 | A1 | 8/2006 | Karles | |
| 2008/0029114 | A1 * | 2/2008 | Seitert | A24D 3/06 131/365 |
| 2008/0142028 | A1 | 6/2008 | Fagg | |
| 2008/0173320 | A1 | 7/2008 | Dunlap | |
| 2008/0302373 | A1 | 12/2008 | Stokes | |
| 2009/0288669 | A1 * | 11/2009 | Hutchens | A24D 3/0216 131/274 |
| 2011/0023900 | A1 | 2/2011 | Clarke | |
| 2011/0100387 | A1 | 5/2011 | Karles | |
| 2011/0120481 | A1 | 5/2011 | Besso | |
| 2011/0162662 | A1 | 7/2011 | Nikolov | |
| 2011/0190105 | A1 | 8/2011 | Fallon | |
| 2011/0271968 | A1 | 11/2011 | Carpenter | |
| 2012/0017926 | A1 * | 1/2012 | Karles | A24D 3/0216 156/178 |
| 2012/0037172 | A1 | 2/2012 | Allen | |
| 2012/0080043 | A1 | 4/2012 | Naenen | |
| 2012/0255569 | A1 | 10/2012 | Beard | |
| 2012/0270710 | A1 | 10/2012 | Deal | |
| 2013/0081644 | A1 | 4/2013 | Noda | |
| 2013/0115452 | A1 * | 5/2013 | Bundren | D01F 2/28 427/322 |
| 2014/0026908 | A1 | 1/2014 | Motadamari | |

FOREIGN PATENT DOCUMENTS

| | | |
|---|---|---|
| CN | 101203148 | 6/2008 |
| CN | 102106607 | 6/2011 |
| CN | 102669817 | 9/2012 |
| CN | 104853629 | 8/2015 |
| EA | 12456 | 10/2009 |
| EA | 13725 | 6/2010 |
| EP | 0649607 | 4/1995 |
| EP | 1845809 | 8/2008 |
| EP | 1906775 | 8/2009 |
| EP | 2213185 | 11/2011 |
| EP | 2537426 | 12/2012 |
| EP | 2856890 | 4/2015 |
| EP | 2856891 | 4/2015 |
| EP | 2932860 | 10/2015 |
| EP | 2740370 | 4/2016 |
| GB | 1204018 | 9/1970 |
| GB | 1470857 | 4/1977 |
| GB | 2161362 | 1/1984 |
| JP | S50-031098 | 3/1975 |
| JP | S53-099354 | 8/1978 |
| JP | S6255068 | 3/1987 |
| JP | 7-250665 | 10/1995 |
| JP | 2928295 | 8/1999 |
| JP | 2000-037182 | 2/2000 |
| JP | 3112468 | 11/2000 |
| JP | 2001-046044 | 2/2001 |
| JP | 2001-520874 | 11/2001 |
| JP | 2005-512554 | 5/2005 |
| JP | 2007-504824 | 3/2007 |
| JP | 2007-507230 | 3/2007 |
| JP | 2007-520204 | 7/2007 |
| JP | 2015-518434 | 5/2008 |
| JP | 2008-528013 | 7/2008 |
| JP | 2008/546400 | 12/2008 |
| JP | 2009-508524 | 3/2009 |
| JP | 2010-528680 | 8/2010 |
| JP | 2011-509682 | 3/2011 |
| JP | 2011/520469 | 7/2011 |
| JP | 2011-250801 | 12/2011 |
| JP | 2012-082389 | 4/2012 |
| JP | 2012-520680 | 9/2012 |
| JP | 2012/523223 | 10/2012 |
| JP | 5068138 | 11/2012 |
| JP | 5710838 | 3/2015 |
| JP | 6255955 | 5/2019 |
| KR | 10-1992-0003914 | 3/1992 |
| KR | 10-2007-009900 | 10/2007 |
| KR | 10-2008-0003908 | 1/2008 |
| KR | 10-2008-0014893 | 2/2008 |
| KR | 10-2009-0008277 | 1/2009 |
| KR | 10-2013-0029457 | 3/2013 |
| WO | WO 2005/032286 | 4/2005 |
| WO | WO 2005/032287 | 4/2005 |
| WO | WO 2006/082161 | 8/2006 |
| WO | WO 2006/082529 | 8/2006 |
| WO | WO 2006/117697 | 11/2006 |
| WO | WO 2006/136197 | 12/2006 |
| WO | WO 2007/060543 | 5/2007 |
| WO | WO 2008/084333 | 7/2008 |
| WO | WO 2009/093051 | 7/2009 |
| WO | WO 2009/094859 | 8/2009 |
| WO | WO 2009/143338 | 11/2009 |
| WO | WO 2010/115829 | 10/2010 |
| WO | WO 2011/024068 | 3/2011 |
| WO | WO 2011/060961 | 5/2011 |
| WO | WO 2011/140430 | 11/2011 |
| WO | WO 2011/152316 | 12/2011 |
| WO | WO 2012/042199 | 4/2012 |
| WO | WO 2012/132009 | 10/2012 |
| WO | WO 2012/156705 | 11/2012 |
| WO | WO 2013/000967 | 1/2013 |
| WO | WO 2013/013786 | 1/2013 |
| WO | WO 2013/017624 | 2/2013 |
| WO | WO 2013/042609 | 3/2013 |
| WO | WO 2013/068081 | 5/2013 |
| WO | WO 2013/068304 | 5/2013 |
| WO | WO 2013/126167 | 8/2013 |
| WO | 2013/179429 | 12/2013 |
| WO | WO 2013/179524 | 12/2013 |
| WO | WO 2014/091605 | 6/2014 |
| WO | WO 2013/021863 | 3/2015 |
| WO | WO 2015/036454 | 3/2015 |

OTHER PUBLICATIONS

Design Characteristics of Ultraslim Products, Report No. RD.2150, B.A.T. (U.K & Export) Ltd., Sep. 1989.

European Extended Search Report for Application No. 13161785.4 dated Oct. 13, 2013 (6 pages).

European Notice of Opposition for Application No. 17184107.5 dated Jun. 25, 2020 (45 pages).

(56) References Cited

OTHER PUBLICATIONS

European Third Party Observations dated Apr. 1, 2019 for European Application No. 17184107.5 (12 pages).
Grip and Pinch Strength: Normative Data for Adults, Mathiowetz et al., Arch. Phys. Med. Rehabil., 66:69-74 (1985).
Korean Third Party Observations dated Apr. 22, 2019 for Korean Application No. 10-2107-7017749 (17 pages).
New Product Development in Cigarettes: Innovate or Fail-Keeping Price in Power, Euromonitor report (2012).
Office Action issued in China for Application No. 201480018138.2 dated May 8, 2019 (19 pages). English translation included.
Office Action issued in China for Application No. 201480018138.2 dated Jun. 25, 2018 (20 pages). English translation included.
Office Action issued in Japan for Application No. 2016-504703 (9 pages). English translation included.
Office Action issued in Japan for Application No. 2016-504703 dated Sep. 25, 2018 (13 pages). English translation included.
Office Action issued in Japan for Application No. 2016-504703 dated Apr. 28, 2016 (8 pages). English translation included.
Office Action issued in Japan for Application No. 2018-000275 dated Oct. 8, 2020 (4 pages). English translation included.
Office Action issued in Japan for Application No. 2020-116298 dated Sep. 8, 2020 (12 pages). English translation included.
Office Action issued in Japan for Application No. 2020-116298 dated Feb. 22, 2021 (11 pages). English translation included.
Office Action issued in Korea for Application No. 10-2015-7024637 dated Jul. 25, 2016 (10 pages). English translation included.
Office Action issued in Russia for Application No. 2015146049 dated Mar. 30, 2018 (English translation included).
PCT Search Report and Written Opinion for PCT/EP2014/056350 dated Jul. 22, 2014 (12 pages).
Screenshot from the Truth Tobacco Industry Documents website.
Screenshot from Truth Tobacco Industry Documents website (2).
Technical Memorandum dated Sep. 4, 1989, uploaded onto the publicly available Truth Tobacco Industry Documents archive (https://www.industrydocumentslibrary.uesf.edu/tobacco/) on Feb. 1, 2002; web address: https://www.industrydocumentslibrary.ucsf.edu/tobacco/docs/zpvoco140.
Webpage retrieved from the archive.org wesbsite: https://web.archive.org/web/20130320235916/https://www.euromonitor.com/new-product-development-in-digarettes-innovate-or-fail-keeping-price-in-power/report.
Office Action issued in Japan for Application No. 2022-038991 dated Jan. 10, 2023 (10 pages). English translation included.
Office Action issued in Japan for Application No. 2023-126089 dated Jun. 16, 2025 (2 pages).
Determination of Crush Strength of Flavour Capsules for Filters—Definitions and Measurement Principles, Aug. 2020 (9 pages).
The Design of Cigarettes, Colin L. Browne, Ph.D., Charlotte, North Carolina, 63 pages.
Office Action issued in Japan for Application No. 2025-119907 dated Mar. 18, 2026 (10 pages). English translation included.

* cited by examiner

SMOKING ARTICLE INCLUDING A FLAVOUR DELIVERY MEMBER

This application is a continuation application of U.S. application Ser. No. 16/568,992, filed Sep. 12, 2019, which is a continuation application of U.S. application Ser. No. 14/778,734, filed Sep. 21, 2015, which is a U.S. National Stage Application of International Application No. PCT/EP2014/056350, filed Mar. 28, 2014, which was published in English on Oct. 2, 2014 as International Patent Publication WO 2014/154887 A1. International Application No. PCT/EP2014/056350 claims priority to European Application No. 13161785.4 filed Mar. 28, 2013. A certified copy of European Application No. 13161785.4 filed Mar. 28, 2013 was provided in, and is available in, U.S. patent application Ser. No. 14/778,734 for which certified copy is available in PAIR.

The present invention relates to a filter for a smoking article, and a smoking article comprising a filter.

Combustible smoking articles, such as cigarettes, generally comprise shredded tobacco (usually in cut filler form) surrounded by a paper wrapper forming a tobacco rod. A cigarette is employed by a consumer by lighting one end thereof and burning the shredded tobacco rod. The consumer then receives mainstream smoke by drawing on the opposite end (mouth end or filter end) of the cigarette. The shredded tobacco can be a single type of tobacco or a blend of two or more types of tobacco.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Smoking articles, particularly cigarettes, generally comprise a filter aligned in end-to-end relationship with a tobacco rod or another aerosol forming substrate. Typically, the filter includes a plug of cellulose acetate tow attached to the tobacco rod or aerosol forming substrate by tipping paper. Ventilation of mainstream smoke can be achieved with a row or rows of perforations in the tipping paper about a location along the filter.

Flavourants can be added to cigarettes and smoking articles. Some consumers may prefer a cigarette that is capable of selectively providing one or more flavours, depending upon the consumer's immediate desire, either in the short term or in the long term. However, certain flavourants are volatile and have the propensity to evaporate or migrate over time, which lessens the effects of those flavourants.

Accordingly, it would be desirable to provide a smoking article and a filter for a smoking article that enhance the transfer of flavour into the smoke and minimize the migration of the flavour while still maintaining other desirable characteristics of the smoking article.

According to a first aspect of the invention, there is provided a filter for a smoking article, the filter comprising: a filter segment comprising filter material, the filter segment having a cross sectional area measured perpendicular to the longitudinal direction of the filter; and a flavour delivery member embedded in the filter segment and surrounded on all sides by the filter material, the flavour delivery member comprising structural material enclosing liquid flavourant for flavouring smoke during smoking, wherein the flavour delivery member releases at least a portion of the liquid flavourant when the filter is subjected to external force; wherein a cross sectional area of the flavour delivery member measured perpendicular to the longitudinal direction of the filter is about 30%, or greater, of the cross sectional area of the filter segment, and wherein the filter material of the filter segment comprises fibres of between about 5.0 and about 12.0 denier per filament and between about 10000 and about 35000 total denier.

The external force may be exerted in any direction, but is preferably exerted in a direction perpendicular to the longitudinal direction of the filter. One preferable method of applying the external force would be for a user to squeeze or exert an external force on the filter containing the flavour delivery member, prior to or during the smoking of the smoking article containing the filter. The squeezing or compression action or application of external force preferably breaks the flavour delivery member, which in turn, causes at least a portion of the liquid flavourant to be released into the filter. Alternatively, the squeezing or compression action may provide a sustained release of liquid flavourant over a range of compression forces. The liquid flavourant may then flavour the smoke passing through the filter. An external device, such as a pinching device, a tube squeezing device, tweezers or any other device for applying compression forces, may also be used to concentrate the force at a prescribed filter location.

The cross sectional area of the flavour delivery member is higher, relative to the cross sectional area of the filter segment, than in filters of the prior art. Because the cross sectional area of the flavour delivery member is about 30% or greater of the cross sectional area of the filter segment, less than about 70% of the cross sectional area of the filter segment remains permeable to air and smoke. Thus, in the filter of the invention, the flavour delivery member has a higher blocking effect than in filters of the prior art. This leads to several effects which are different from those found in prior art filters and may be advantageous. Firstly, the filter can have a higher resistance to draw (RTD), before the flavour delivery member releases the liquid flavourant, than prior art filters. This is because air and smoke flowing through the filter segment are forced through a relatively small area of filter material around the flavour delivery member. Such a high RTD may create a new and unusual sensory experience for the consumer. Secondly, once the filter is subjected to external force and the flavour delivery member releases the liquid flavourant (for example, when the flavour delivery member breaks), the increased cross-sectional area of the filter segment that is permeable to the flow of gas results in a sudden flow of air and smoke through the filter. That is, there is a drop in RTD (from a relatively high starting RTD) and there is also a noticeable change in flavour due to the liquid flavourant. Again, this creates an exciting and stimulating sensory experience for the consumer.

Thirdly, because the dimensions of the flavour delivery member are high relative to the dimensions of the filter segment, there may be a risk that the flavour delivery member will be damaged during manufacture or handling (because the flavour delivery member is closer to the outer side of the filter). However, the present inventor has appreciated that, by embedding the flavour delivery member within the filter material, the flavour delivery member is more protected during manufacture and handling. The flavour delivery member is supported in the filter material. However, it is still possible for a consumer to locate the flavour delivery member in the filter and apply the necessary external force for the liquid flavourant to be released. This allows the filter of the invention to use larger flavour delivery members (relative to the dimensions of the filter) than could be used in a cavity in the filter, for example in a plug-space-plug filter. Embedding the flavour delivery member in the filter material of the filter segment may have the added advantage that manufacturing can be more straightforward, since the flavour delivery member may be incorporated amongst the fibres of the filter material tow. Thus, conventional manufacturing techniques may be used in which continuous tow material, with embedded flavour delivery members, is cut into filter segments. No separate step of inserting the flavour delivery member is required.

According to the present invention, the filter material of the filter segment is selected appropriately in order to achieve the desired balance of RTD (including the RTD before and after the liquid flavourant is released), an appropriate amount of material to support the flavour delivery member adequately within the filter segment, and an appropriate amount of material to avoid deformation of the filter material around the flavour delivery member.

In particular, the filter material of the filter segment comprises fibres of between about 5.0 and about 12.0 denier per filament and between about 10000 and about 35000 total denier. Such filter material has a lower total density than filter materials in which flavour delivery members are embedded in the prior art. This can provide the desired RTD, whilst providing an appropriate amount of material to support the flavour delivery member but avoid a bulge in the filter material around the flavour delivery member.

Preferably, the filter segment comprises fibres having about 6.0 denier per filament (dpf) or greater. In a preferred embodiment, the filter segment comprises large diameter fibres of about 8.0 dpf. Preferably, the filter segment has a total denier of less than about 30000, more preferably less than about 25000. Additionally, or alternatively, the filter segment preferably has a total denier of greater than about 12000. In a preferred embodiment, the filter segment comprises large diameter fibres of about 15000 total denier. The number of fibres present in the filter segment (the total denier divided by the dpf) may be less than about 6,000, preferably less than about 5,000. Such filter materials have been found to provide a good balance, when the flavour delivery member is embedded in the filter material, between RTD and flavour delivery member support, whilst avoiding deformation of the filter material.

An additional advantage provided by using a filter material according to the present invention is that it facilitates embedding the flavour delivery member in the filter material. The inventors have appreciated that by embedding the flavour delivery member within a filter material having a lower relative total density, the flavour delivery member is protected during manufacture and handling, even though the flavour delivery member may be closer to the outer surfaces of the filter. Using a filter material with a lower total density allows the flavour delivery member to be embedded, without producing deformation (for example, a bulge) in the filter. The lower density material effectively provides space for the flavour delivery member to be incorporated into the filter material. At the same time, the filter material still provides the fibres at the outer extremity of the filter to wick away the flavour and facilitate the smoke to pick up the flavor.

Another additional advantage provided by using a filter material according to the present invention is that, in the case of slim cigarettes having a diameter of about 6.0 mm or less, the lower density filter material allows standard tar delivery levels to be achieved and flavour to be maximised, even though such smoking articles may contain a relatively small amount of tobacco.

As already discussed, according to the filter of the invention, the cross sectional area of the filter which is blocked by the flavour delivery member is greater than in prior art arrangements. Thus, a smoking article utilizing such a filter may have a higher RTD, before the liquid flavourant is released, than prior art smoking articles. Such a high RTD may create a new and unusual sensory experience for the consumer. The smoking article RTD, before the liquid flavourant is released, may be greater than about 130 mm $H_2O$, more preferably greater than about 150 mm $H_2O$. Additionally, or alternatively, the smoking article RTD may be less than about 210 mm $H_2O$. Preferably, the smoking article RTD is between about 130 mm $H_2O$ and about 210 mm $H_2O$, more preferably between about 150 mm $H_2O$ and about 210 mm $H_2O$.

In addition, when the flavour delivery member is crushed, there is a drop in RTD, which may also create a new and unusual sensory experience for the consumer. The drop in RTD may result from the flavour delivery member being reduced in size when it is crushed. The smoking article RTD, after the flavour delivery member is crushed, may decrease at least about 10 mm $H_2O$, preferably decrease at least about 20 mm $H_2O$, and more preferably decrease at least about 30 mm $H_2O$.

In this specification, the terms "upstream" and "downstream" are used to describe relative positions between elements of the filter or smoking article in relation to the direction of mainstream smoke as it is drawn from a lit end of the smoking article through the filter.

In this specification, the expression "surrounded on all sides" is used to mean that the flavour delivery member is directly adjacent filter material of the filter segment in the upstream and downstream (longitudinal) directions and also in the transverse direction. That is, the flavour delivery member is completely embedded within the filter material, and is not in a separate cavity. Preferably, flavour delivery members are incorporated into the filter material during manufacture of the filter material. For example, the flavour delivery members may be incorporated amongst the fibres of a continuous rod of filter material, which may then be cut into filter segments.

The cross sectional area of the flavour delivery member, measured perpendicular to the longitudinal direction of the filter, is about 30% or greater of the cross sectional area of the filter segment, also measured perpendicular to the longitudinal direction of the filter. Or, to put this another way, the proportion of the cross sectional area of the filter segment which remains permeable to air and smoke once the flavour delivery member is embedded in the filter material is less than about 70%. (If the filter includes a wrapper such as plug wrap or tipping paper, the cross sectional area of the filter segment is generally measured inside the wrapper.) Preferably, the cross sectional area of the flavour delivery member is greater than about 30%, and may also be less than about 80%, of the cross sectional area of the filter segment. Or, to put this another way, the proportion of the cross sectional area of the filter segment which remains permeable to air and smoke once the flavour delivery member is embedded in the filter material is preferably greater than about 20% and less than about 70%.

More preferably, the cross sectional area of the flavour delivery member measured perpendicular to the longitudinal direction of the filter is about 45%, or greater, of the cross sectional area of the filter segment. Or, to put this another way, the proportion of the cross sectional area of the filter segment which remains permeable to air and smoke once the flavour delivery member is embedded in the filter material is less than about 55%. Preferably, the cross sectional area of the flavour delivery member is greater than about 45%, and may also be less than about 80%, of the cross sectional area of the filter segment. Or, to put this another way, the proportion of the cross sectional area of the filter segment which remains permeable to air and smoke once the flavour delivery member is embedded in the filter material is preferably greater than about 20% and less than about 55%.

Even more preferably, the cross sectional area of the flavour delivery member measured perpendicular to the longitudinal direction of the filter is about 55%, or greater, of the cross sectional area of the filter segment. Or, to put this another way, the proportion of the cross sectional area of the filter segment which remains permeable to air and smoke once the flavour delivery member is embedded in the filter material is less than about 45%. Preferably, the cross sectional area of the flavour delivery member is greater than about 55%, and may also be less than about 80%, of the cross sectional area of the filter segment. Or, to put this another way, the proportion of the cross sectional area of the filter segment which remains permeable to air and smoke once the flavour delivery member is embedded in the filter material is preferably greater than about 20% and less than about 45%.

Preferably, the filter has a diameter of less than about 6.5 mm. More preferably, the diameter of the filter is between about 3.6 mm and about 6.5 mm. (The diameter of the filter is generally measured inside any wrapper materials such as plug wraps or tipping papers, unless otherwise indicated in the specification.) More preferably, the diameter of the filter is between about 3.6 mm and about 5.5 mm. Even more preferably, the diameter of the filter is between about 3.6 mm and about 4.5 mm.

The filter may have a length of about 27 mm and the centre of the flavour delivery member may be located about 13.5 mm from the downstream end of the filter. In that case, if the filter segment is the only component of the filter, the centre of the flavour delivery member is located about 13.5 mm from the downstream end of the filter segment or, if the filter includes additional filter elements, the centre of the flavour delivery member is located about 13.5 mm from the downstream end of the filter, which may or may not be the downstream end of the filter segment. Or the filter may have a length of about 32 mm and the centre of the flavour delivery member may be located about 16 mm from the downstream end of the filter. In that case, if the filter segment is the only component of the filter, the centre of the flavour delivery member is located about 16 mm from the downstream end of the filter segment or, if the filter includes additional filter elements, the centre of the flavour delivery member is located about 16 mm from the downstream end of the filter, which may or may not be the downstream end of the filter segment. In this specification, the "centre" of the flavour delivery member refers to the mid-point between the furthest downstream and furthest upstream portions of the flavour delivery member.

The flavour delivery member may be located symmetrically or asymmetrically within the filter. If the flavour delivery member is located symmetrically within the filter, the centre of the flavour delivery member is equidistant between the upstream and downstream ends of the filter. The filter may include one or more additional filter elements upstream of the filter segment, downstream of the filter segment or both upstream and downstream of the filter segment. If the filter includes additional elements and the flavour delivery member placement is symmetric with respect to the whole filter, the flavour delivery member placement may be either symmetric or asymmetric with respect to the filter segment, depending on the position and length of the additional filter elements. If the flavour delivery member is located asymmetrically within the filter, the centre of the flavour delivery member is not equidistant between the upstream and downstream ends of the filter. For example, the flavour delivery member may be located in the upstream third of the filter or in the downstream third of the filter. If the filter includes additional elements and the flavour delivery member placement is asymmetric with respect to the whole filter, the flavour delivery member placement may either symmetric or asymmetric with respect to the filter segment, depending on the position and length of the additional filter elements.

In one preferred embodiment, the filter segment and the flavour delivery member are circular in cross section, the diameter of the filter segment is between about 3.6 mm and about 6.5 mm and the diameter of the flavour delivery member, measured perpendicular to the longitudinal direction of the filter, is between about 2.5 mm and about 4.5 mm. For example, the diameter of the filter segment (inside any filter wrapper) may be about 6.1 mm. For example, the diameter of the flavour delivery member may be about 3.5 mm. In this embodiment, the cross sectional area of the flavour delivery member measured perpendicular to the longitudinal direction of the filter is about 33% of the cross sectional area of the filter segment. Or, to put this another way, the proportion of the cross sectional area of the filter segment which remains permeable to air and smoke once the flavour delivery member is embedded in the filter material is about 67%. A filter having a diameter of about 6.1 mm may be used in a "slim cigarette" having an overall diameter of about 7.0 mm.

In another preferred embodiment, the filter segment and the flavour delivery member are circular in cross section, the diameter of the filter segment is between about 3.6 mm and about 5.5 mm and the diameter of the flavour delivery member, measured perpendicular to the longitudinal direction of the filter, is between about 3.0 mm and about 3.5 mm. For example, the diameter of the filter segment (inside any filter wrapper) may be about 4.5 mm. For example, the diameter of the flavour delivery member may be about 3.2 mm. In this embodiment, the cross sectional area of the flavour delivery member measured perpendicular to the longitudinal direction of the filter is about 51% of the cross sectional area of the filter segment. Or, to put this another way, the proportion of the cross sectional area of the filter segment which remains permeable to air and smoke once the flavour delivery member is embedded in the filter material is about 49%. A filter having a diameter of less than about 4.5 mm may be used in a "super slim cigarette" having an overall diameter of less than about 5.4 mm.

In another preferred embodiment, the filter segment and the flavour delivery member are circular in cross section, the diameter of the filter segment is between about 3.6 mm and about 4.5 mm and the diameter of the flavour delivery member, measured perpendicular to the longitudinal direction of the filter, is between about 3.0 mm and about 3.5 mm. For example, the diameter of the filter segment (inside any filter wrapper) may be about 3.8 mm. For example, the diameter of the flavour delivery member may be about 3.2 mm. In this embodiment, the cross sectional area of the flavour delivery member measured perpendicular to the longitudinal direction of the filter is about 71% of the cross sectional area of the filter segment. Or, to put this another way, the proportion of the cross sectional area of the filter segment which remains permeable to air and smoke once the flavour delivery member is embedded in the filter material is less than about 29%. A filter having a diameter of about 3.8 mm may be used in a "micro slim cigarette" having an overall diameter of about 4.7 mm.

The term "flavour delivery member" refers to any delivery system for delivering a flavour, in this case comprising structural material enclosing liquid flavourant. Provision of a flavour delivery member which releases the liquid flavourant when the filter is subjected to an external force allows the liquid flavourant to be controllably released by the consumer. The external force may be applied, and hence the liquid flavourant released, prior to or during use of the smoking article. The external force on the flavour delivery member allows the liquid flavourant to escape from the flavour delivery member and interact with and modify the characteristics of the smoking article and thus the smoke derived therefrom. Because the liquid flavourant is only released when an external force is applied to the filter, this reduces the chance of the liquid flavourant migrating or disintegrating, for example, during storage.

The flavour delivery member may have any desired size, as long as a cross sectional area of the flavour delivery member measured perpendicular to the longitudinal direction of the filter is about 30% of the cross sectional area of the filter segment or greater. For example, the flavour delivery member may be spherical with a diameter between about 2.5 mm and about 4.5 mm, preferably between about 3.0 mm and about 3.5 mm. Or, the flavour delivery member may be spherical with a diameter less than about 3.4 mm, preferably about 3.2 mm.

Small flavour delivery members may present a number of manufacturing challenges. By using a flavour delivery member having a cross sectional area about 30% of the cross sectional area of the filter segment or greater, such manufacturing challenges may be avoided in some embodiments. A larger flavour delivery member, relative to the filter segment, maximises the amount of liquid flavourant enclosed within the flavour delivery member and may achieve a desired flavour level for a consumer. In the case of a flavour delivery member comprising an outer shell and an inner core, a larger flavour delivery member also includes a proportionately thicker outer shell. Such a shell is relatively straightforward to manufacture consistently and with the desired burst strength.

The flavour delivery member may have any suitable structure in which a structural material encloses the liquid flavourant. The flavour delivery member may comprise a matrix structure defining a plurality of domains, the liquid flavourant being trapped within the domains until released when the filter is subjected to external force. More preferably, however, the flavour delivery member comprises a capsule. Preferably, the capsule comprises an outer shell and an inner core containing the liquid flavourant. Preferably, the outer shell is substantially continuous. Preferably, the outer shell is sealed before the application of the external force, but is frangible or breakable to allow liquid flavourant to be released when the external force is applied. The capsule may be formed in a variety of physical formations including, but not limited to, a single-part capsule, a multi-part capsule, a single-walled capsule, a multi-walled capsule, a large capsule, and a small capsule.

If the flavour delivery member comprises a matrix structure defining a plurality of domains enclosing the liquid flavourant, the flavour delivery member may release the liquid flavourant when the filter is subjected to external force over a range of force of at least 5 N. The flavour delivery member's force versus compression curve may have a peak between about 5 N and about 24 N. Alternatively, if the flavour delivery member is a capsule arranged to rupture or burst to release the liquid flavourant when the filter is subjected to external force (for example, but not limited to, if the capsule comprises an outer shell and an inner core), the capsule may have any desired burst strength. The burst strength is the force (exerted on the capsule from the outside of the filter) at which the capsule will burst. The burst strength may be a peak in the capsule's force versus compression curve. Preferably, the capsule has a burst strength of between about 5 N (0.5 kgf) and about 24 N (2.4 kgf). More preferably, the capsule has a burst strength of between about 8 N (0.8 kgf) and about 20 N (2.0 kgf). Even more preferably, the capsule has a burst strength of between about 12 N (1.2 kgf) and about 16 N (1.6 kgf).

The flavour delivery member may have any suitable shape, for example, spherical, spheroid, or ellipsoid. Preferably, however, the flavour delivery member is generally spherical. This may include flavour delivery members having a sphericity value of at least about 0.9, and preferably a sphericity value of approximately 1. Sphericity is a measure of how spherical an object is, with a perfect sphere having a sphericity value of 1. Sphericity values may be derived by determining the average of the largest diameter and the smallest diameter, deducting the difference between the largest diameter and the smallest diameter from the average, then dividing the result by that average. Preferably, the generally spherical flavour delivery member comprises a generally spherical outer shell.

The flavour delivery member may be manufactured according to any suitable method (for example, by co-extrusion), as will be appreciated by those skilled in the art.

Preferably, only a single flavour delivery member is embedded in the filter. However, additional flavour delivery members may be provided in the longitudinal direction of the filter. The additional flavour delivery members may be provided in the same filter segment or in additional filter segments. If additional flavour delivery members are provided in the filter, they may have the same or different properties as one another.

The flavour delivery member may comprise any suitable material or combination of materials, for example those used in capsules for drug delivery, liquid encapsulated capsules, or other encapsulated materials. By way of example, a flavour delivery member typically utilized in the pharmaceutical industry may be used. Such flavour delivery members may be gelatin based, for example, or may be formed from a polymeric material, such as modified cellulose. One type of modified cellulose which may be used is hydroxypropylmethyl cellulose. In addition to gelatin or modified cellulose, or in addition to both gelatin and modified cellulose, the outer shell may comprise polysaccharide.

The liquid flavourant may comprise any flavour compound or tobacco extract suitable for being releasably disposed in liquid form within the flavour delivery member to enhance the taste of mainstream smoke produced during smoking of a smoking article containing the filter. Suitable flavours or flavourings include, but are not limited to, menthol, mint, such as peppermint and spearmint, chocolate, liquorice, citrus and other fruit flavours, gamma octalactone, vanillin, ethyl vanillin, breath freshener flavours, spice flavours such as cinnamon, methyl salicylate, linalool, bergamot oil, geranium oil, lemon oil, ginger oil, and tobacco flavour. Other suitable flavours may include flavour compounds selected from the group consisting of an acid, an alcohol, an ester, an aldehyde, a ketone, a pyrazine, combinations or blends thereof and the like.

The filter material (of the filter segment or any additional filter elements) may comprise any suitable material or materials. Examples of suitable materials include, but are not limited to, cellulose acetate, cellulose, reconstituted cellulose, polylactic acid, polyvinyl alcohol, nylon, polyhydroxybutyrate, polypropylene, paper, thermoplastic material, such as starch, non-woven materials, and combinations thereof. One or more of the materials may be formed into an open cell structure. Preferably, the filter material comprises cellulose acetate tow.

The filter may include additional material, either in the filter segment or in one or more additional elements incorporated in the filter. For example, the additional material may be incorporated into fibrous filter tow of the filter segment or an additional filter element. For example, the filter may include a sorbent material. The term "sorbent" refers to either an adsorbent, an absorbent, or a substance that may perform both of these functions. The sorbent material may comprise activated carbon. The sorbent may be incorporated into the filter segment in which the flavour delivery member is embedded. More preferably, however, the sorbent is incorporated into an additional filter element upstream of the filter segment. Alternatively or additionally, the filter may include an adhesive, a plasticiser or flavour release agent, or a combination thereof.

If a sorbent material, such as activated carbon, is provided in the filter, either in the filter segment in which the flavour delivery member is embedded or in an additional filter element, preferably the flavour delivery member is downstream of the sorbent material. Such an arrangement allows for the filtration of the smoking article to be effected by the sorbent, and for the liquid flavourant to be released into the filter without the effectiveness of the liquid flavourant being affected by absorption or adsorption by the sorbent.

The filter may contain flavour release agents, such as flavoured cellulose thread, sepiolite, molecular sieves or activated carbon impregnated with flavours.

The filter may include one or more additional filter elements upstream, downstream or both upstream and downstream, of the filter segment. If the filter includes additional elements, the filter segment with embedded flavour delivery member is only a filter component of the smoking article filter, rather than the whole smoking article filter. The additional filter elements may be axially aligned with the filter segment. For example, the filter may further include a plug or plugs or disc or discs of filter material downstream of the filter segment, a plug or plugs or disc or discs of filter material upstream of the filter segment, or plugs or discs of filter material downstream and upstream of the filter segment. Alternatively or additionally, the filter may further include a hollow tube or tubes downstream of the filter segment, a hollow tube or tubes upstream of the filter segment, or hollow tubes downstream and upstream of the filter segment. If more than one hollow tube is provided, the hollow tubes may have the same or different dimensions. Alternatively, or additionally, the filter may further include a space or cavity downstream or upstream or both downstream and upstream of the filter segment. Such a space or cavity may be defined by a filter wrapper circumscribing the filter material. The space or cavity may be empty or may be filled with any suitable material.

Various filter constructions may be used, in which one or more flavour delivery members may be incorporated. Exemplary filter structures that may be used include, but are not limited to, a mono filter, a dual filter, a triple filter, a single or multi cavity filter, a recessed filter, a free-flow filter, and combinations thereof. Mono filters typically contain cellulose acetate tow or cellulose paper materials. Dual filters typically comprise a cellulose acetate mouth end and a pure cellulose or cellulose acetate segment. The length and pressure drop of the segments in a dual filter may be adjusted to provide optimal sorption, while maintaining acceptable RTD. Cavity filters include at least two segments, for example, acetate-acetate, acetate-paper or paper-paper, separated by at least one cavity. Recessed filters include an open cavity at the mouth end.

The filter may include a filter wrapper circumscribing at least the filter material. A filter wrapper provides strength and structural rigidity for the filter, including the filter segment. Preferably, where the filter includes one or more additional filter elements, the filter segment and the one or more additional filter elements are overwrapped with a filter wrapper. The filter wrapper may comprise any suitable material. The filter wrapper may prevent deformation on the outside of the filter segment at the location where the flavour delivery member is embedded in the filter material. The filter wrapper may include a seam including one or more lines of adhesive. Preferably, the seam includes two lines of adhesive. One line of adhesive may comprise a hot melt adhesive. One line of adhesive may comprise polyvinyl alcohol.

Filters according to the present invention may advantageously be used in filter cigarettes and other smoking articles in which tobacco material is combusted to form smoke. Filters according to the present invention may alternatively be used in smoking articles in which tobacco material is heated, rather than combusted, to form an aerosol. Filters according to the present invention may also be used in smoking articles in which a nicotine-containing aerosol is generated from a tobacco material, tobacco extract, or other nicotine source, without combustion or heating.

According to a second aspect of the invention, there is provided a smoking article comprising: an aerosol forming substrate; and a filter according to the first aspect of the invention. According to the second aspect of the invention, there is provided a smoking article comprising: a tobacco substrate; and a filter according to the first aspect of the invention. According to the second aspect of the invention, there is also provided a smoking article comprising: a tobacco rod; and a filter according to the first aspect of the invention.

In the case of a conventional cigarette, the aerosol forming substrate may comprise a tobacco-containing portion, sometimes referred to as a tobacco rod or cigarette rod. The cigarette therefore typically contains two sections: the tobacco-containing portion and the filter. Tipping paper typically surrounds the filter, which forms the mouth end of the cigarette. The tipping paper overlaps with the tobacco rod in order to hold the filter and tobacco rod together. The tobacco rod typically includes the paper wrapper in which the tobacco is wrapped and the adhesive holding the seams of the paper wrapper together. The tobacco rod has a first end which is attached to the filter and a second end which is lit or heated for smoking the tobacco. When the tobacco rod is lit or heated for smoking, the smoke travels from the lit end downstream to the filter end of the tobacco rod and further downstream through the filter.

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used. In traditional cigarette manufacture, the tobacco is normally used in the form of cut filler, that is, in the form of shreds or strands cut into widths ranging from about 2.5 mm to about 1.2 mm or even about 0.6 mm. The lengths of the strands range from between about 6 mm to about 75 mm. Slim cigarettes (having a diameter of about 6.0 mm or less) may not require expanded tobacco. Preferably, in a slim cigarette, less than about 20% of the total tobacco in the cigarette is expanded tobacco.

Preferably, the tobacco packing density in the smoking article is equal to or larger than about 200 $mgcm^{-3}$. More preferably, the tobacco packing density in the smoking article is equal to or larger than about 220 $mgcm^{-3}$. Even more preferably, the tobacco packing density in the smoking article is equal to or larger than about 240 $mgcm^{-3}$. Slim cigarettes (having a diameter of about 6.0 mm or less) may allow relatively high packing or filling densities of about 200 $mgcm^{-3}$.

Preferably, the smoking article further comprises tipping material attaching the tobacco rod or other aerosol forming substrate and the filter. The tipping material may provide additional strength and structural rigidity for the filter segment and reduce the chance of deformation on the outer surface of the filter segment at the location where the flavour delivery member is embedded in the filter material.

The tipping material may include a ventilation zone comprising perforations through the tipping material. The degree of ventilation is preferably above about 60%, more preferably above about 70%, even more preferably above about 80%. The degree of ventilation is preferably less than about 95%, more preferably less than about 90%, even more preferably less than about 85%. The degree of ventilation is preferably between about 60% and about 95%, more preferably between about 70% and about 90%, even more preferably between about 80% and about 85%. Ventilation may reduce both the particulate phase and the gas phase constituents of the mainstream smoke. However, smoking articles having high levels of ventilation may have RTD levels which are too low to be considered acceptable to a consumer. However, with the addition of the embedded flavour delivery member in the filter which, because of its relatively high cross sectional area results in a larger RTD, the filter may have the desired RTD level. If used with high ventilation, the flavour delivery member can increase RTD while both the particulate phase and the gas phase constituents of the mainstream smoke are reduced.

The tipping material may include at least one row of perforations to provide ventilation of the mainstream smoke. If the filter includes a filter wrapper, preferably, the perforations extend through the filter wrapper. Alternatively, the filter wrapper may be permeable. The tipping material may be standard pre-perforated tipping material. Alternatively, the tipping material may be perforated (for example, using a laser) during the manufacturing process according to the desired number, size and position of the perforations. The number, size and position of the perforations may be selected to provide the desired level of ventilation. The ventilation, in conjunction with the flavour delivery member and the filter material, produces the desired level of RTD. The RTD of the smoking article, before the liquid flavourant is released (for example, before the flavour delivery member is crushed), may be greater than about 130 mm $H_2O$.

Preferably, the ventilation zone is provided upstream of the flavour delivery member. This is to reduce the chance of liquid flavourant leaking out of the perforations after the liquid flavourant is released. In one embodiment, the filter has a length of about 27 mm, the centre of the flavour delivery member is located about 13.5 mm from the downstream end of the filter, and a row of perforations is provided about 18 mm from the downstream end of the filter. In that case, if the filter segment is the only component of the filter, the row of perforations is located about 18 mm from the downstream end of the filter segment or, if the filter includes additional filter elements, the row of perforations is located about 18 mm from the downstream end of the filter, which may or may not be the downstream end of the filter segment. In another embodiment, the filter has a length of about 32 mm. The row of perforations may be provided at least about 11 mm from the downstream end of the filter.

According to one embodiment, the smoking article further comprises tipping material attaching the tobacco substrate and the filter, the tipping material including a ventilation zone comprising perforations through the tipping material, the perforations being located upstream of the flavour delivery member.

Preferably, the tipping material is substantially impermeable to the liquid flavourant of the flavour delivery member. Low permeability tipping material prevents the liquid flavourant permeating the tipping material and causing unsightly staining on the outside of the tipping material. Any suitable material may be used, for example, but not limited to, cellophane and polyvinylidene chloride.

A third aspect of the invention is directed to the use of a flavour delivery member in a filter for a smoking article, the filter comprising a filter segment comprising filter material, wherein the filter segment has a cross sectional area measured perpendicular to the longitudinal direction of the filter, the flavour delivery member is embedded in the filter segment and surrounded on all sides by the filter material, the flavour delivery member comprises structural material enclosing liquid flavourant for flavouring smoke during smoking, wherein the flavour delivery member releases at least a portion of the liquid flavourant when the filter is subjected to external force, and wherein a cross sectional area of the flavour delivery member measured perpendicular to the longitudinal direction of the filter is about 30% or greater of the cross sectional area of the filter segment.

According to a fourth aspect of the invention, there is provided a method for manufacturing filters for smoking articles, the method comprising the steps of: providing a continuous rod of filter material having flavour delivery members embedded in the filter material and spaced apart in the longitudinal direction of the rod, wherein each flavour delivery member comprises structural material enclosing liquid flavourant, and wherein a cross sectional area of each flavour delivery member measured perpendicular to the longitudinal direction of the rod is about 30% or greater of the cross sectional area of the rod; and cutting the continuous rod of filter material at longitudinally spaced cut lines, to produce filter segments of filter material, each filter segment including a flavour delivery member embedded in the filter segment and surrounded on all sides by the filter material.

The method of the fourth aspect of the invention is straightforward since the flavour delivery members are incorporated directly into the filter material. For example, the flavour delivery members may be incorporated with fibres of filter material as they are bundled to form filter material tow. No separate step of inserting the flavour delivery member is required.

Features described in relation to one aspect of the invention may also be applicable to another aspect of the invention.

The invention will be further described, by way of example only, with reference to the accompanying drawings in which.

Figure 1:
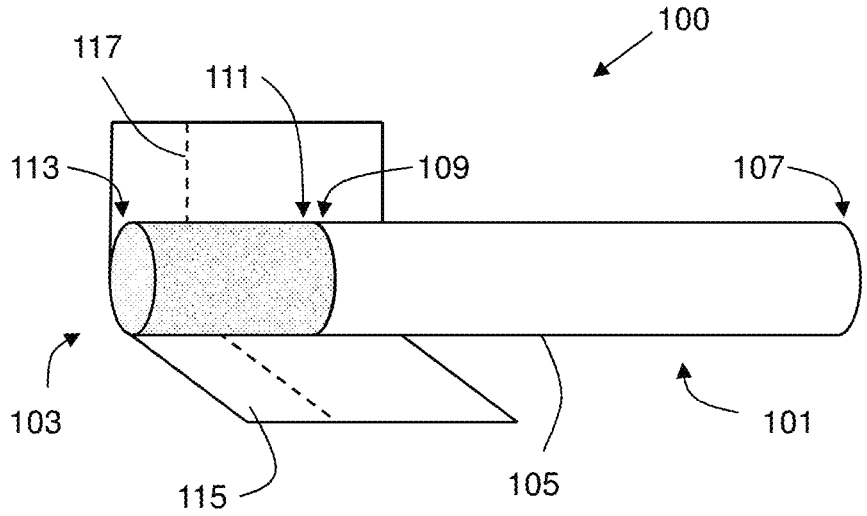
FIG. 1 is a perspective view of a smoking article according to an embodiment of the invention.

FIG. 1 is a perspective view of a smoking article 100 according to one embodiment of the invention. The smoking article 100 includes a generally cylindrical tobacco rod 101 and a generally cylindrical filter 103. The tobacco rod 101 and filter 103 are axially aligned in an end-to-end relationship, preferably abutting one another. The tobacco rod includes an outer wrapper 105 circumscribing the smoking material. The outer wrapper 105 may be a porous wrapping material or paper wrapper. The tobacco is preferably a shredded tobacco or tobacco cut filler. The tobacco rod 101 has an upstream, lit end 107 and a downstream end 109. The filter 103 has an upstream end 111 and a downstream, mouth end 113. The upstream end 111 of the filter 103 is adjacent the downstream end 109 of the tobacco rod 101. The filter material of the filter 103 is wrapped in a filter wrapper (not shown). Although not visible in FIG. 1, a flavour delivery member in the form of a capsule is embedded in the filter 103.

The filter 103 is attached to the tobacco rod 101 by tipping material 115 which circumscribes the entire length of the filter 103 and an adjacent region of the tobacco rod 101. The tipping material 115 is shown partially removed from the smoking article in FIG. 1, for clarity. The tipping material 115 is typically a paper like product. However, any suitable material can be used. Preferably, the tipping material comprises a material which is substantially impermeable to the liquid flavourant in the capsule. In this embodiment, the tipping material 115 includes a circumferential row of perforations 117 aligned with the filter 103. The perforations are provided for ventilation of the mainstream smoke, and are located upstream of the capsule (not shown) embedded in the filter 103.

In this specification, the "upstream" and "downstream" relative positions between smoking article components are described in relation to the direction of mainstream smoke as it is drawn from the tobacco rod 101 and through the filter 103.

Figure 2:
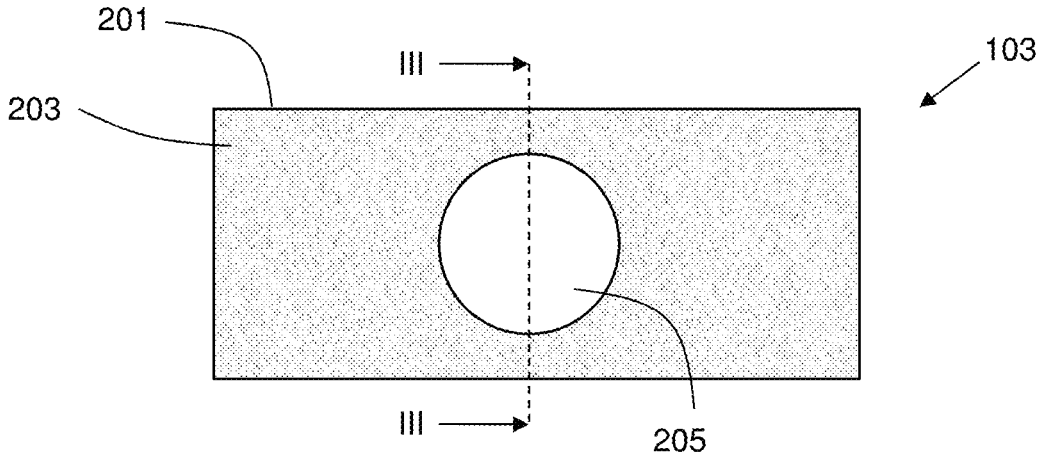
FIG. 2 is a cross sectional view of a filter according to an embodiment of the invention.
Figure 3:
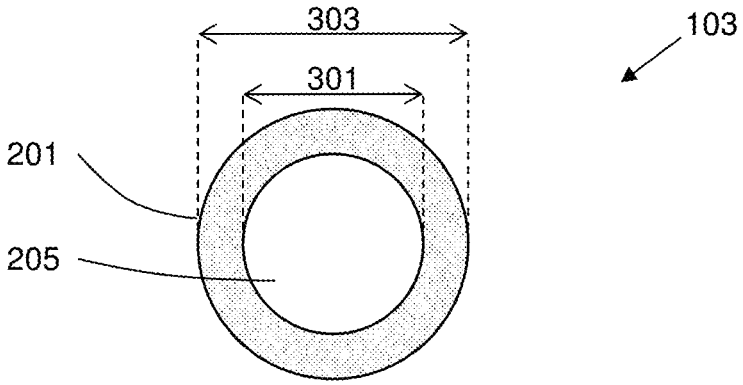
FIG. 3 is a cross sectional view along line III-III of FIG. 2.

FIG. 2 is a cross sectional view of filter 103 of FIG. 1 according to an embodiment of the invention. FIG. 3 is a cross sectional view along line III-III of FIG. 2. In FIGS. 2 and 3, the filter 103 comprises a filter segment 201 of filter material 203. The filter 103 further comprises a flavour delivery member in the form of spherical capsule 205.

In the embodiment of FIGS. 2 and 3, the capsule 205 is embedded in the filter segment 201 and is surrounded on all sides by the filter material 203. In this embodiment, the capsule comprises an outer shell and an inner core, and the inner core contains a liquid flavourant. The liquid flavourant is for flavouring smoke during smoking of a smoking article provided with the filter. The capsule 205 releases at least a portion of the liquid flavourant when the filter is subjected to external force, for example by squeezing by a consumer. In the embodiment shown in FIGS. 2 and 3, the capsule is generally spherical, with a substantially continuous outer shell containing the liquid flavourant.

As shown in FIG. 3, capsule 205 has a diameter 301, and filter segment 201 has a diameter 303 (inside the filter wrapper). The cross sectional area of capsule 205 measured in a direction perpendicular to the longitudinal direction of the filter is therefore circular area $\pi(\mathbf{301})^2$. Similarly, the cross sectional area of filter segment 201 measured in a direction perpendicular to the longitudinal direction of the filter is circular area $\pi(\mathbf{303})^2$. Therefore, the cross sectional area of the capsule 205 as a percentage of the cross sectional area of the filter segment 201 is $$\frac{\pi(301)^2}{\pi(303)^3} = \left(\frac{301}{303}\right)^2.$$

Example 1

According to a first example of the invention, the diameter 301 of the capsule 205 is about 3.5 mm, the diameter 303 of the filter segment 201 inside the filter wrapper is about 6.41 mm and the diameter of the filter segment 201 outside the filter wrapper is about 7.21 mm. The diameter of the cigarette (which may be referred to as a slim cigarette) containing the filter is about 7.35 mm. In this embodiment, the cross sectional area of the capsule is about 30% of the cross sectional area of the filter segment. In this embodiment, the cigarette may have a length of about 97 mm or about 83 mm. In this embodiment, the filter may have a length of about 27 mm or about 32 mm, and the tipping paper may have a length of about 32 mm or about 36 mm. A circumferential row of perforations may be provided at least about 11 mm, preferably about 18 mm, from the mouth end, and the centre of the capsule may be about 13.5 mm from the mouth end.

Example 2

According to a second example of the invention, the diameter 301 of the capsule 205 is about 3.5 mm, the diameter 303 of the filter segment 201 inside the filter wrapper is about 6.19 mm and the diameter of the filter segment 201 outside the filter wrapper is about 6.99 mm. The diameter of the cigarette (which may be referred to as a slim cigarette) containing the filter is about 7.10 mm. In this embodiment, the cross sectional area of the capsule is about 32% of the cross sectional area of the filter segment. In this embodiment, the cigarette may have a length of about 97 mm or about 83 mm. In this embodiment, the filter may have a length of about 27 mm or about 32 mm, and the tipping paper may have a length of about 32 mm or about 36 mm. A circumferential row of perforations may be provided at least about 11 mm, preferably about 18 mm, from the mouth end, and the centre of the capsule may be about 13.5 mm from the mouth end.

Example 3

According to a third example of the invention, the diameter 301 of the capsule 205 is about 3.5 mm, the diameter 303 of the filter segment 201 inside the filter wrapper is about 6.09 mm and the diameter of the filter segment 201 outside the filter wrapper is about 6.89 mm. The diameter of the cigarette (which may be referred to as a slim cigarette) containing the filter is about 7.00 mm. In this embodiment, the cross sectional area of the capsule is about 33% of the cross sectional area of the filter segment. In this embodiment, the cigarette may have a length of about 97 mm or about 83 mm. In this embodiment, the filter may have a length of about 27 mm or about 32 mm, and the tipping paper may have a length of about 32 mm or about 36 mm. A circumferential row of perforations may be provided at least about 11 mm, preferably about 18 mm, from the mouth end, and the centre of the capsule may be about 13.5 mm from the mouth end.

Example 4

According to a fourth example of the invention, the diameter 301 of the capsule 205 is about 3.2 mm, the diameter 303 of the filter segment 201 inside the filter wrapper is about 4.55 mm and the diameter of the filter segment 201 outside the filter wrapper is about 5.35 mm. The diameter of the cigarette (which may be referred to as a super slim cigarette) containing the filter is about 5.41 mm. In this embodiment, the cross sectional area of the capsule is about 49% of the cross sectional area of the filter segment. In this embodiment, the cigarette may have a length of about 97 mm or about 83 mm. In this embodiment, the filter may have a length of about 27 mm or about 32 mm, and the tipping paper may have a length of about 32 mm or about 36 mm. A circumferential row of perforations may be provided at least about 11 mm, preferably about 18 mm, from the mouth end, and the centre of the capsule may be about 13.5 mm from the mouth end.

Example 5

According to a fifth example of the invention, the diameter 301 of the capsule 205 is about 3.0 mm, the diameter 303 of the filter segment 201 inside the filter wrapper is about 3.84 mm and the diameter of the filter segment 201 outside the filter wrapper is about 4.64 mm. The diameter of the cigarette (which may be referred to as a micro slim cigarette) containing the filter is about 4.70 mm. In this embodiment, the cross sectional area of the capsule is about 61% of the cross sectional area of the filter segment. In this embodiment, the cigarette may have a length of about 97 mm or about 83 mm. In this embodiment, the filter may have a length of about 27 mm or about 32 mm, and the tipping paper may have a length of about 32 mm or about 36 mm. A circumferential row of perforations may be provided at least about 11 mm, preferably about 18 mm, from the mouth end, and the centre of the capsule may be about 13.5 mm from the mouth end.

Example 6

According to a sixth example of the invention, the diameter 301 of the capsule 205 is about 3.2 mm, the diameter 303 of the filter segment 201 inside the filter wrapper is about 3.84 mm and the diameter of the filter segment 201 outside the filter wrapper is about 4.64 mm. The diameter of the cigarette (which may be referred to as a micro slim cigarette) containing the filter is about 4.70 mm. In this embodiment, the cross sectional area of the capsule is about 69% of the cross sectional area of the filter segment. In this embodiment, the cigarette may have a length of about 97 mm or about 83 mm. In this embodiment, the filter may have a length of about 27 mm or about 32 mm, and the tipping paper may have a length of about 32 mm or about 36 mm. A circumferential row of perforations may be provided at least about 11 mm, preferably about 18 mm, from the mouth end, and the centre of the capsule may be about 13.5 mm from the mouth end.

The invention claimed is:

1. A filter for a smoking article, the filter comprising:
a filter segment comprising filter material, the filter segment having a cross sectional area measured perpendicular to the longitudinal direction of the filter; and
a flavour delivery member embedded in the filter segment and surrounded on all sides by the filter material, the flavour delivery member comprising structural material enclosing liquid flavourant for flavouring smoke during smoking, wherein the flavour delivery member releases at least a portion of the liquid flavourant when the filter is subjected to external force;
wherein a cross sectional area of the flavour delivery member measured perpendicular to the longitudinal direction of the filter is about 30%, or greater, of the cross sectional area of the filter segment,
wherein the filter material of the filter segment comprises fibres of between about 5.0 and about 12.0 denier per filament and between about 10000 and about 30000 total denier; and
wherein the filter material of the filter segment comprises at least one of paper and a non-woven material.

2. A filter according to claim 1, wherein the filter is a recessed filter including an open cavity at a mouth end, and further comprises a cavity upstream of the filter segment.

3. A filter according to claim 1, wherein the filter further comprises a hollow tube upstream of the filter segment.

4. A filter according to claim 1, wherein the proportion of the cross sectional area of the filter segment which remains permeable to air and smoke once the flavour delivery member is embedded in the filter material is preferably greater than about 20%.

5. A filter according to claim 1, wherein the flavour delivery member is located downstream of the filter.

6. A filter according to claim 1, wherein the flavour delivery member embedded in the filter segment and surrounded on all sides by the filter material, such that the flavour delivery member is directly adjacent filter material of the filter segment in the upstream and downstream (longitudinal) directions and also in the transverse direction.

7. A filter according to claim 1, wherein the flavour delivery member is equidistant between the upstream and downstream ends of the filter segment.

8. A filter according to claim 1, wherein the flavour delivery member comprises a capsule.

9. A filter according to claim 8, wherein the capsule has a burst strength of between about 5 N and about 24 N.

10. A filter according to claim 1, wherein the filter material comprises fibres of between about 5.0 and about 12.0 denier per filament and between about 12000 and about 30000 total denier.

11. A filter according to claim 1, wherein the filter segment and the flavour delivery member are circular in cross section, the diameter of the flavour delivery member is between about 2.5 mm and about 4.5 mm.

12. A smoking article comprising:
a tobacco substrate; and
the filter according to claim 1.

13. A smoking article according to claim 12, wherein the tobacco substrate is a tobacco rod.

14. A smoking article according to claim 12, further comprising tipping material attaching the tobacco substrate and the filter, the tipping material including a ventilation zone comprising perforations through the tipping material, the perforations being located upstream of the flavour delivery member.

15. A smoking article according to claim 14, wherein the degree of ventilation provided by the ventilation zone is above about 60%.

16. A smoking article according to claim 14, wherein the tipping material is substantially impermeable to the liquid flavourant of the flavour delivery member.

17. A smoking article according to claim 12, wherein the RTD of the smoking article, before the liquid flavourant is released, is greater than about 130 mm $H_2O$.

* * * * *